United States Patent [19]

Ooya et al.

[11] Patent Number: 4,995,535

[45] Date of Patent: Feb. 26, 1991

[54] NOZZLE DEVICE FOR DISCHARGING MOLTEN METAL

[75] Inventors: Satoshi Ooya; Sadanobu Sugiura, both of Anjo; Teruhisa Kawashima, Kariya; Toshio Kawamura, Takahama, all of Japan

[73] Assignee: Toshiba Ceramics Co., Ltd., Tokyo, Japan

[21] Appl. No.: 484,543

[22] Filed: Feb. 26, 1990

[30] Foreign Application Priority Data

Apr. 21, 1989 [JP] Japan ..... 1-101914

[51] Int. Cl.[5] ..... B22D 37/00

[52] U.S. Cl. ..... 222/607; 222/606

[58] Field of Search ..... 222/591, 606, 607, 600

[56] References Cited

U.S. PATENT DOCUMENTS

| | | | |
|---|---|---|---|
| 4,079,869 | 3/1978 | Meier et al. | 222/607 |
| 4,393,985 | 7/1983 | Müller et al. | 222/607 |
| 4,911,338 | 3/1990 | Winkelmann et al. | 222/600 |

FOREIGN PATENT DOCUMENTS

| | | | |
|---|---|---|---|
| 0874886 | 7/1971 | Canada | 222/607 |

*Primary Examiner*—S. Kastler

*Attorney, Agent, or Firm*—Oblon, Spivak, McClelland, Maier & Neustadt

[57] ABSTRACT

A nozzle device for discharging molten metal comprising a nozzle having a tapered portion whose outside diameter decreases toward the lower end, a metal holder mounted on the tapered portion and supporting the nozzle, and a ceramic receiving member whose inside surface is parallel with the surface of the tapered portion, the member provided between the tapered portion and the metal holder.

11 Claims, 2 Drawing Sheets

NOZZLE DEVICE FOR DISCHARGING MOLTEN METAL

BACKGROUND OF THE INVENTION

1. Field of the Invention

The present invention relates to a nozzle device for discharging molten metal, and more specifically to a nozzle device having an improved member supporting a nozzle.

2. Description of the Related Art

FIG. 4 shows a conventional nozzle device for discharging molten metal (prior art 1). Nozzle 1 has right-angled step portion 2 on the outer periphery of its upper end portion. Metal holder 3, which has a right-angled inner surface, is mounted on step portion 2. Nozzle 1 also has through hole 4 extending in the axial direction, for discharging molten metal.

FIG. 5 shows another conventional nozzle device for discharging molten metal (prior art 2). Nozzle 5 has tapered portion 6 on the outer periphery of its upper end portion. The outer diameter of tapered portion 6 gradually decreases toward the lower end. Metal holder 7 is mounted on the upper end portion of nozzle including tapered portion 6.

However, the conventional nozzle devices thus arranged have the following drawbacks:

(1) Prior art 1

Since stress is likely to concentrate on the holder 3 and is applied to step portion 2, the neck portion of nozzle 1 tends to break.

(2) Prior art 2

Since stress does not concentrate on holder 7, due to the presence of tapered portion 6, the neck portion of nozzle 5 is less likely to break than in the case of prior art 1. However, during the time the nozzle device is in use, holder 7 expands diametically, because of the heat of the molten metal flowing through it. As a result, nozzle 5 slips down from the holder. If nozzle 5 has slipped down a considerable extent by the time holder 7 begins to contract during a ladle exchanging operation or cooling operation, it will then be held tightly by holder 7, resulting in shearing stress being generated by the compressive force, and causing nozzle 5 to crack.

SUMMARY OF THE INVENTION

The object of the present invention is to provide a nozzle device for discharging molten metal, in which the neck portion of the nozzle is protected against breaking due to contraction of the holder as a result of a cooling operation being performed.

According to the present invention, there is provided a nozzle device for discharging molten metal and comprising:

a nozzle having a tapered portion whose outside diameter decreases toward the lower end;

a metal holder mounted o the tapered portion and supporting the nozzle; and a ceramic receiving member whose inside surface is parallel to the surface of the tapered portion, the receiving member being provided between the tapered portion and the metal holder.

The ceramic receiving member should preferably be made of a refractory material such as $Si_3N_4$, $Al_2O_3$, $ZrO_2$, SiC, $Al_2O_3$-$SiO_2$, $SiO_2$, MgO, or MgO-$Al_2O_3$, or a fine ceramic product, and may be a ring or a ring-shaped member consisting of a plurality of parts each of which should be fixed to the inside surface of the metal holder by adhesive.

The inside surface of the metal holder should preferably be right-angled, as should also the outside periphery of the ceramic receiving member, so as to fit together with the inside surface of the metal holder.

In addition, it is preferable that a shrunk ring be interposed between the ceramic receiving member (if a receiving ring is used) and the metal holder, in order to improve the durability of the ceramic receiving member.

Further, it is desirable that a ring-shaped heat insulating member is mounted on a step portion of the upper end portion of the through hole of the nozzle, to prevent the metal holder from being deformed by heat. The heat insulating member may be made of an element of the $Al_2O_3$-$SiO_2$ series, the $SiO_2$ series, the $Al_2O_3$ series, the $ZrO_2$ series, or the like.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

A nozzle device according to an embodiment of the present invention will now be described below, with reference to FIGS. 1 and 2.

Figure 1:
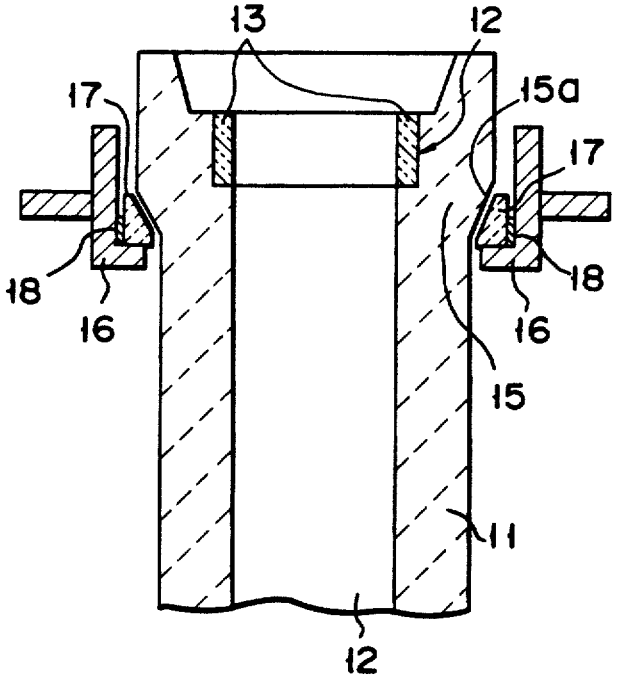
FIG. 1 is a sectional view of a nozzle device for discharging molten metal according to a embodiment of the present invention.

FIG. 1 shows a nozzle 11 having a through hole 12 through which molten metal is discharged. Right-angled step portion 13 is provided on the inside surface of the upper end portion of through hole 12, and sheet-like heat insulating member 14, made, for example, of an element of the $Al_2O_3$ series, is provided in step portion 13.

Tapered portion 15 forms part of the outside surface of the upper end portion of nozzle 11, and has a tapered surface 15*a*. The outside diameter of tapered portion 15 gradually decreases toward the lower end of the nozzle. Metal holder 16, having right-angled inside surface portions, is mounted on that part of the upper end portion of nozzle 11 at which tapered portion 15 is located, and thus supports nozzle 11 at that point. Ceramic receiving ring 17 (see FIG. 2) is interposed between tapered portion 15 of nozzle 11 and metal holder 16, and is made of $Si_3N_4$ product sintered at atmospheric pressure, $Al_2O_3$ refractories (60 parts by weight of $Al_2O_3$, 40 parts by weight of $SiO_2$), or the like. The inside surface of receiving ring 17 is tapered so as to be parallel to tapered surface 15*a* of tapered portion 15, and has right-angled outside surfaces. Metal shrunk ring 18 is interposed between holder 16 and ring 17.

The above-described nozzle device for discharging molten metal comprises, as shown in FIG. 1, nozzle 11 having tapered portion 15 whose outside diameter decreases toward the lower end, metal holder 16 mounted on tapered portion 15 of nozzle 11 for supporting nozzle 11, ceramic receiving ring 17 which is interposed between tapered portion 15 of nozzle 11 and metal holder 16 and whose inside surface is tapered so as to be parallel to tapered surface 15*a* of tapered portion 15, and metal shrunk ring 18 interposed between holder 16 and receiving ring 17. Because of the structure as described above, the nozzle device has the following advantages.

(1) Since ceramic receiving ring 17 has a small coefficient of thermal expansion, the inside diameter of ring 17 does not increase, and nozzle 11 slips down much less as compared to the conventional nozzle device. Hence, even if holder 16 contracts due to cooling, nozzle 11 is prevented from being held tight by holder 16, and no stress is applied to nozzle 11.

(2) Since ceramic receiving ring 17 has a small coefficient of thermal conductivity, the temperature in holder 16 increases little. Accordingly, heat distortion of holder 16 is very small.

(3) Since shrunk ring 18 is interposed between metal holder 16 and receiving ring 17, the durability of receiving ring 17 is improved.

(4) Since sheet-like heat insulating member 14 is provided in right-angled stepped portion 13 of through hole 12 of long nozzle 11, holder 16 is prevented from heat deformation.

Figure 4:
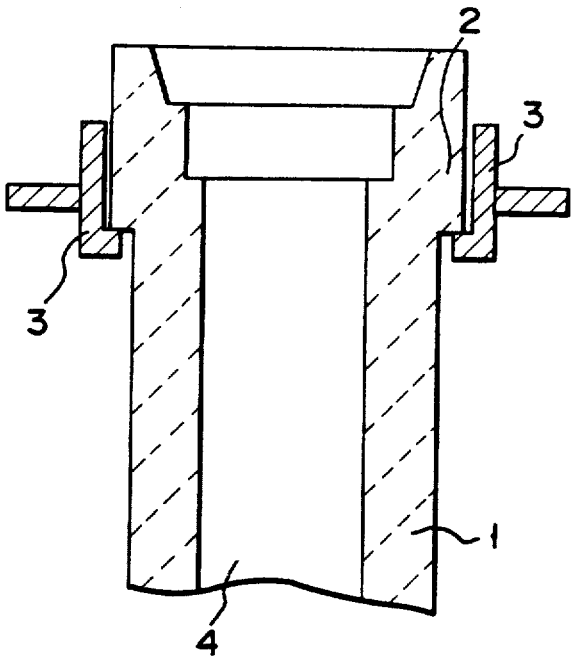
FIGS. 4 and 5 are sectional views of conventional nozzle devices for discharging molten metal.
Figure 5:
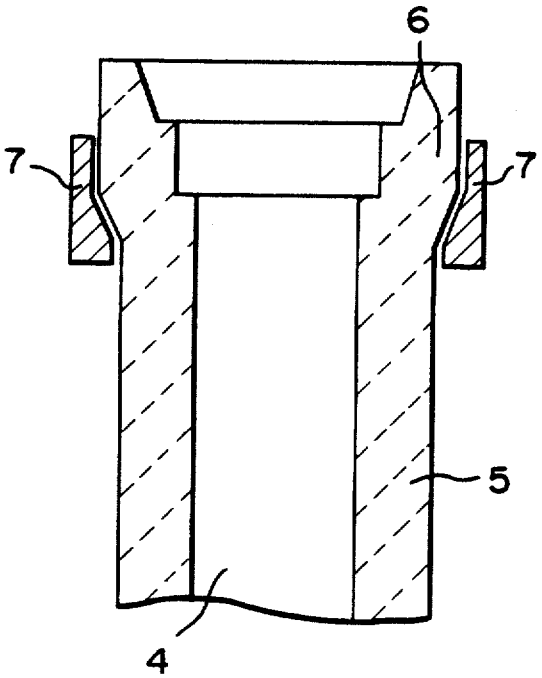

According to an experiment, when the nozzle device as shown in FIG. 4 or 5 was used between a ladle and a tundish, the neck portion of the long nozzle was broken in two out of ten cases. In contrast, when the nozzle device of the present invention as shown in FIG. 1 was used, no breakage occurred.

Figure 2:
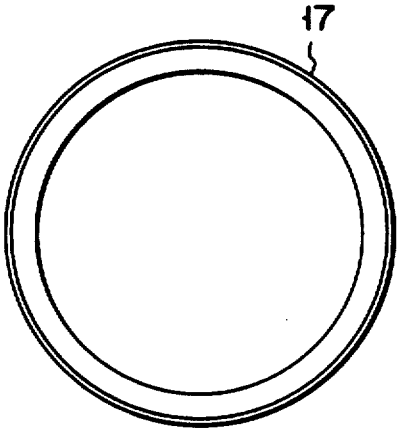
FIG. 2 is a plan view of a receiving member of the nozzle device shown in FIG. 1.
Figure 3:
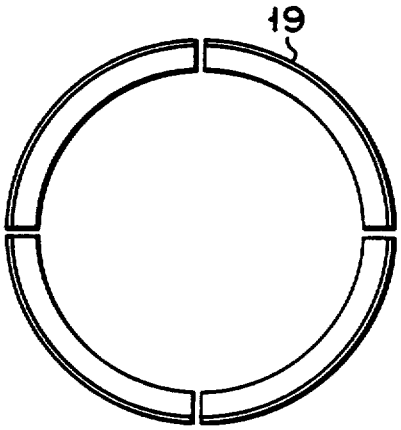
FIG. 3 is a plan view of a receiving member of a type other than that shown in FIG. 2.

The present invention is not limited to the above described embodiment in which the ceramic receiving member as shown in FIG. 2 is used. For example, ring-shaped member 19, as shown in FIG. 3, consisting of four parts, can be used. The number of the parts need not be four. The receiving member is required to have an inside surface parallel to the tapered surface of the tapered portion of the long nozzle, and an outside surface fitting to the inside surface of the holder.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. The nozzle device for discharging molten metal comprising:

a nozzle having a tapered portion whose outer diameter decreases toward the lower end;

a metal holder mounted on the tapered portion and supporting the nozzle; and an annular receiving member consisting of a plurality of parts and interposed between the tapered portion and metal holder, the annular receiving member being attached to the inner peripheral surface of the metal holder by an adhesive and having an inner peripheral surface thereof extending along the outer peripheral surface of the tapered portion, and the annular receiving member being formed of $Si_3N_4$, $Al_2O_3$, $ZrO_2$, SiC, $Al_2O_3$-$SiO_2$, $SiO_2$, or MgO-$Al_2O_3$, or formed by a fine ceramic product.

2. A nozzle device for discharging molten metal comprising:

a nozzle having a tapered portion whose outer diameter decreases toward the lower end;

a metal holder mounted on the tapered portion and supporting the nozzle; and a ceramic receiving member whose inside surface is parallel to the surface of the tapered portion, the receiving member being interposed between the tapered portion and the metal holder;

wherein said ceramic receiving member is a ring-shaped member consisting of a plurality of parts and each of the parts of the ring-shaped member is fixed to the inside surface of said metal holder by adhesive.

3. The nozzle device for discharging molten metal according to claim 2, wherein said ceramic receiving member is made of $Si_3N_4$, $Al_2O_3$, $ZrO_2$, SiC, $Al_2O_3$-$SiO_2$, $SiO_2$, MgO, or MgO-$Al_2O_3$, or a fine ceramic product.

4. The nozzle device for discharging molten metal according to claim 1, wherein the outside surface of said annular receiving member is right-angled so as to fit together with the inside surface of the metal holder.

5. The nozzle device for discharging molten metal according to claim 1, wherein a shrunk ring is interposed between said annular receiving member and said metal holder.

6. The nozzle device for discharging molten metal according to claim 1, wherein a ring-shaped heat insulating member is provided in a step portion of the upper end portion of the through hole of the nozzle.

7. The nozzle device for discharging molten metal according to claim 6, wherein said ring-shaped heat insulating member is made of the $Al_2O_3$-$SiO_2$ series, the $SiO_2$ series, the $Al_2O_3$ series, or the $ZrO_2$ series.

8. The nozzle device for discharging molten metal according to claim 2, wherein the outside surface of said ceramic receiving member is right-angled so as to fit together with the inside surface of the metal holder.

9. The nozzle device for discharging molten metal according to claim 2, wherein a shrunk ring is interposed between said ceramic receiving member and said metal holder.

10. The nozzle device for discharging molten metal according to claim 2, wherein a ring-shaped heat insulating member is provided in a step portion of the upper end portion of the through hole of the nozzle.

11. The nozzle device for discharging molten metal according to claim 10, wherein said ring-shaped heat insulating member is made of the $Al_2O_3$-$SiO_2$ series, the $SiO_2$ series, the $Al_2O_3$ series, or the $ZrO_2$ series.

* * * * *